US006745648B2

(12) United States Patent
Stier

(10) Patent No.: US 6,745,648 B2
(45) Date of Patent: Jun. 8, 2004

(54) LOCK-NUT WRENCH

(75) Inventor: Randal J. Stier, Central Square, NY (US)

(73) Assignee: Specialty Welding & Fabricating of New York, Inc., Syracuse, NY (US)

( * ) Notice: Subject to any disclaimer, the term of this patent is extended or adjusted under 35 U.S.C. 154(b) by 0 days.

(21) Appl. No.: 10/251,714

(22) Filed: Sep. 23, 2002

(65) Prior Publication Data

US 2004/0055427 A1 Mar. 25, 2004

(51) Int. Cl.[7] ..... B25B 13/08
(52) U.S. Cl. ..... 81/119; 81/176.1; D8/17
(58) Field of Search ..... 81/119, 176.1; D8/16, 17, 19, 21, 27, 28, 105

(56) References Cited

U.S. PATENT DOCUMENTS

| | | | | | |
|---|---|---|---|---|---|
| 464,084 | A | * | 12/1891 | Robinson | 81/176.1 |
| 489,429 | A | * | 1/1893 | Brigger | 81/176.1 |
| 1,972,239 | A | | 9/1934 | Rose | |
| 2,522,038 | A | | 9/1950 | Houghton | |
| 2,830,480 | A | | 4/1958 | Brame | |
| 3,003,379 | A | * | 10/1961 | Pribitzer | 81/119 |
| 3,768,345 | A | | 10/1973 | Barnes | |
| 3,905,255 | A | * | 9/1975 | Evans | 81/119 |
| 3,931,749 | A | * | 1/1976 | Evans | 81/119 |
| 4,222,293 | A | * | 9/1980 | Schreyer et al. | 81/119 |
| D329,788 | S | * | 9/1992 | Andrew | D8/17 |
| 5,285,703 | A | * | 2/1994 | Carson | 81/423 |
| 5,524,511 | A | | 6/1996 | Taka's | |
| D379,053 | S | | 5/1997 | Howard | |
| 6,269,715 | B1 | * | 8/2001 | Cagny | 81/119 |
| 6,408,723 | B1 | * | 6/2002 | Zurbuchen | 81/119 |

* cited by examiner

*Primary Examiner*—Joseph J. Hail, III
*Assistant Examiner*—David B. Thomas
(74) *Attorney, Agent, or Firm*—Bernhard P. Molldrem, Jr.

(57) ABSTRACT

A lock-nut wrench has an elongated handle and a head at one or both ends of the handle. The head or heads have right and left arcuate jaws with distal ends that define a gap and each jaw has a first radially inwardly directed tooth at its distal end and a second radially inwardly directed tooth spaced proximally from it, defining spaces to accommodate diametrically opposed lugs. An offset can join each head to the handle. The inside of the head, that is, the inside of the jaws proximal of the second teeth, define a cylindrical surface that matches the radial outer extent of the lock nut lugs. The wrench can operate as a spanner, and can accommodate either a six- or an eight-lug lock nut. The handle is coated with an insulating plastic material. The ends of the jaws can be snubbed or hog-nosed. The wrench head may be adapted for use with a socket wrench handle. The wrench can be formed by laser-machining sheet or plate metal stock.

14 Claims, 3 Drawing Sheets

LOCK-NUT WRENCH

BACKGROUND OF THE INVENTION

This invention is directed to tools for installation of electrical equipment, and is more specifically directed to wrenches for tightening the lock nuts that are employed for securing metal (or non-metal) electrical conduit to a metal electrical junction box. The invention is more particularly concerned with a hand tool that facilitates the speedy and efficient installation of electrical work in conduit.

Electrical power is provided through metal conduit for industrial, commercial and residential installations. The metal conduit connects into a metal electrical box, i.e., junction box, fuse or breaker box, or the like, and a circular penetration (e.g., a knock-out) is provided in the box, with the conduit passing through this and being secured to the box with threaded metal fasteners. Lock nuts are used as the fasteners on the inside of the box, and these have some structure on them that penetrates the paint or other coating on the box when the nut is installed as the means for completing the ground path between the conduit and the box. The typical lock nut has an annular body with a female-threaded round opening that screws onto the male thread provided on the end of the conduit, and a number of ears or lugs that radiate out from the annular body. The electrician installs these on the conduit and turns them down by hand. Then the electrician has to secure them by using a tool, and as often as not this tool is a screwdriver that is placed against one of the lugs and is hammered to turn the lock nut. It would be more efficient, and safer, if a wrench were provided to apply torque to the lock nuts, but these have not been available to the electrician.

There have; been some wrenches proposed in the prior art, but they have had only limited success, and are not now commercially available. These earlier wrenches include a conduit wrench as described in Rose U.S. Pat. No. 1,972,239; a junction box wrench as described in Houghton U.S. Pat. No. 2,522,038; a square-drive lock-nut wrench as shown in Barnes U.S. Pat. No. 3,768,345; a wrench-like lock-nut tool as described in Takas U.S. Pat. No. 5,524,511; and a double-ended open lock-nut wrench as shown in Howard U.S. Des. Pat. No. Des. 379,053. These tools have not proved to be practicable, or else have been too expensive to manufacture. Instead it is desired to have a simple tool that can be used with a variety of styles of lock nut, and which the electrician can easily and securely set onto the lock nut and rotate without slipping off.

OBJECTS AND SUMMARY OF THE INVENTION

Accordingly, it is an object to provide the lock nut wrench of an improved design that is simple to use and is relatively inexpensive to manufacture, and which facilitates secure engagement of the lock nuts onto the conduit and electrical junction box.

It is another object to provide a lock nut wrench that can be used easily with either six- or eight-lug lock nuts.

It is a further object to provide a lock nut wrench that helps the electrician in the case that the tool contacts a live (electrified) metal surface.

According to an aspect of this invention, a lock-nut wrench is provided for tightening the lock nuts that secure a metal conduit to a metal electrical junction box. As aforementioned, the typical lock nuts have a generally annular, i.e., cylindrical body with a female thread that engages a male thread on the conduit and a plurality of regularly spaced, outward, radially-directed lugs. At least some of the lock-nut lugs or ears have a foot or edge that cuts into the metal wall of the electrical box when the lock nut is rotated tight on the conduit, to complete the ground path between the conduit and the box. The lock-nut wrench of this invention has an elongated handle that is adapted to be gripped by the electrician, and a head at one end of the handle or else first and second heads at opposite ends of the handle. The head or heads have right and left arcuate jaws with distal ends that define an opening or gap of sufficient size to pass over the associated conduit. Each jaw has a first radially inwardly directed tooth at its distal end and a second radially inwardly directed tooth spaced proximally or back from it; the first and second teeth of each jaw defining between them a space to accommodate one lug of the lock nut. The resulting spaces on each head are 180 degrees apart, to capture the two 180-degree opposed lugs of the lock nut. There can be an offset where each head is joined to the handle, so that the handle and the head lie in parallel planes, or with the handle having a moderate amount of tilt. This facilitates reaching lock nuts at surfaces that may be below or behind a flange or lip at the front or open side of the junction box. In a preferred embodiment, the inside of the head, that is, the remainder of the jaws proximal of the second teeth, is free of further teeth and define a cylindrical surface that matches the radial outer extent of at least one lug of the lock nut. The handle may connect to the center of the head, so the opening between the jaws is centered, but the handle may instead connect to any portion of the head so the gap or opening is oriented in a different direction In another embodiment, the wrench may be a socket member, with a tab that is adapted to receive a socket wrench square drive or hex drive. Alternatively, it may have a male hex or other member to receive a female drive.

The smooth or toothless arcuate surface between the two second teeth lets the wrench operate as a spanner, and also lets the wrench accommodate either a six- or an eight-lug lock nut. The arcuate surface fits up against the outer edges of the lugs, and lets the wrench teeth lever against the captured lugs of the lock washer.

Preferably, the wrench handle is covered with an insulating plastic coating. The wrench is manufactured, e.g., by laser cutting a sheet of a suitable steel, and this allows the handle, jaws and teeth to be of a uniform thickness. The inwardly directed teeth do not slip off the lock nut while it is being turned. The offset can be created with a bending press.

The above and many other objects, features, and advantages of this invention will become apparent from the ensuing description of a selected preferred embodiment, which is to be considered in connection with the accompanying Drawing.

DETAILED DESCRIPTION OF THE PREFERRED EMBODIMENT

Figure 1:
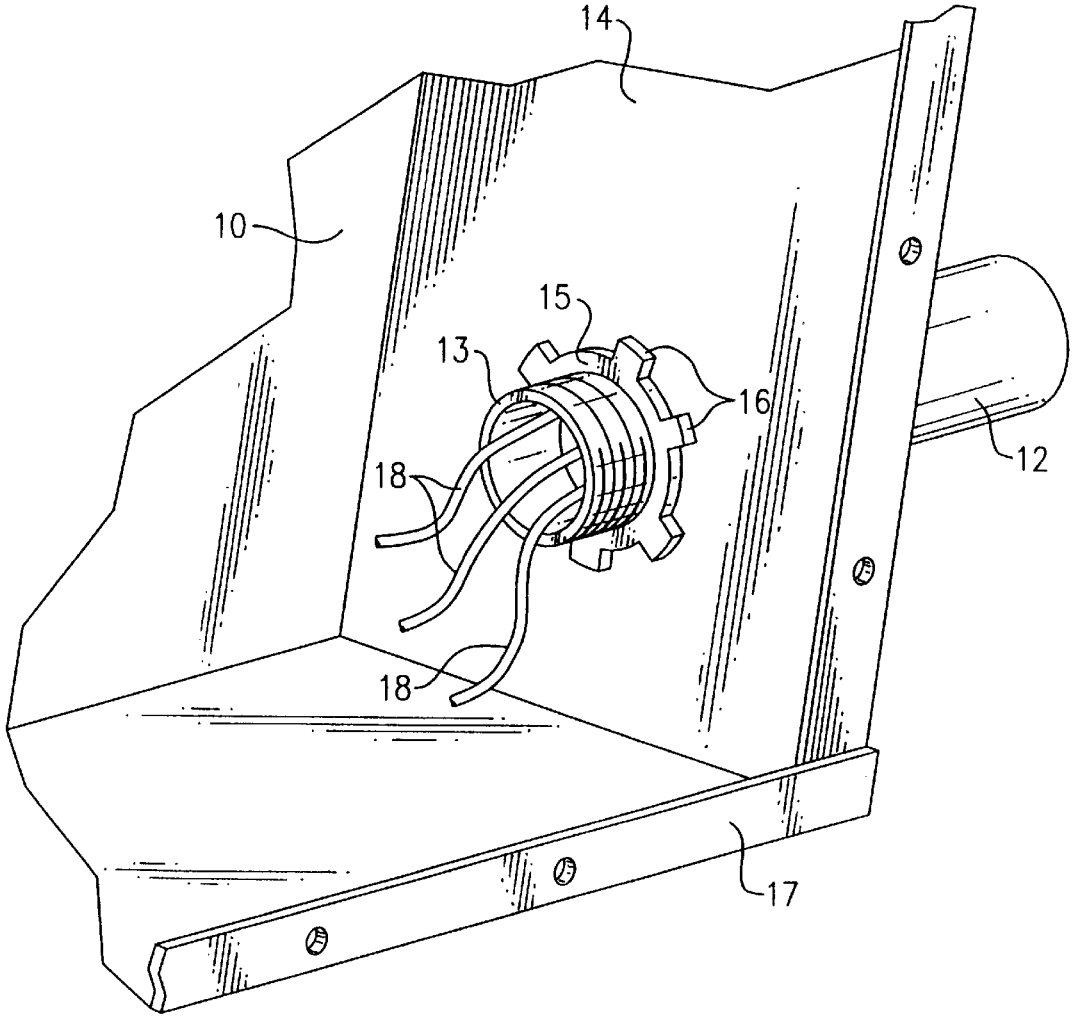
FIG. 1 is a partial perspective view of an electrical junction box, showing a metal conduit and a lugged lock washer securing the conduit to one wall of the box.

With reference to the Drawing, FIG. 1 thereof illustrates an electrical junction box 10, here showing a metal conduit 12 having a threaded end 13 that penetrates through an opening on one side wall 14. A six-lug lock nut 15 has a female thread that mates with the spiral thread on the conduit end 13, and this is turned down into contact with the wall 14. On each lug 16 of the lock-nut there is a sharp edge or flange that cuts into the metal surface of the wall 14 when the lock nut is twisted down tightly, and this makes electrical contact between the conduit 12 and the junction box 10, and also locks the lock nut 12 against rotation. However, in order to tighten the lock nut securely, some tool needs to be used. Unfortunately, the electrician traditionally uses a screwdriver and hammers it to tighten the lock nuts, placing the screwdriver blade against one of the lock-nut lugs and then rapping against the handle of the screwdriver.

As also shown here, there can typically be a flange or rim 17 on the open side of the junction box 10, and with this flange being above the plane of the lock nut 15, the flange 17 can obstruct access to the lock nut 15, making it even more difficult to tighten. In some electrical boxes, the back or side walls, or other internal structure, can also get in the way of a typical style of wrench, making it difficult to turn the lock nut.

FIG. 1 also shows electrical wires 18 that may be carried through the conduit 12, and which are connected to devices or other electrical wires (not shown) within the box 10.

Figure 2:
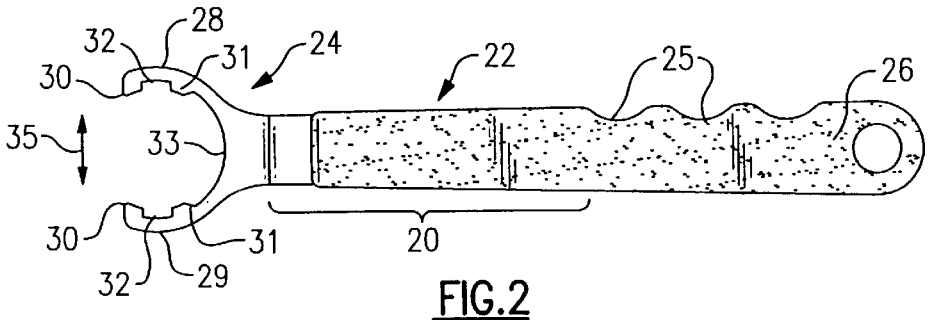
FIG. 2 is a top plan view of lock nut wrench according to one embodiment of this invention.
Figure 3:
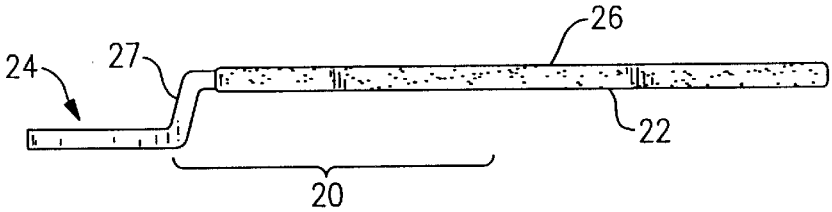
FIG. 3 is a side view of the lock nut wrench of this embodiment.

A lock-nut wrench 20 according to one embodiment of the invention is shown in FIGS. 2 and 3. This wrench 20 is unitarily formed, i.e., it is of one-piece metal construction, with the wrench having an elongated handle 22 and a head 24 situated at one end, to wit a distal end, of the handle 22. The handle 22 is generally flat (FIG. 3) and preferably has serrations 25 formed along one edge as finger grips. A plastic coating 26 covers the handle 22 for comfort and to facilitate gripping and also is an insulator to help prevent shocks if the wrench 20 should make contact with a live (electrified) metal surface, or with an electrically hot wire. An offset or double bend 27 is provided at the distal end so that the head 24 lies in a plane that is parallel to that of the handle 22, but is offset by a sufficient amount to allow the wrench to clear the flange or rim 17 of the junction box 10. In other embodiments, the handle can be angled slightly to moderately.

The head 24 is adapted for fitting over and engaging the lock nut 15, and is generally of a round shape with two arcuate jaws 28 and 29 that bow out from the center where the head meets the handle. Each of the jaws has a first tooth 30 that is oriented radially inward at the distal end of the respective jaw. Each jaw 28, 29 has a second tooth 31 that is spaced somewhat to the proximal side of the first tooth, so that there is a space or gap 32 between the respective first and second teeth 30, 31. An arcuate surface 33 continues across the inside of the head 24 from the second tooth 32 of one jaw 28 to the second tooth 31 of the other jaw 29.

Figure 4:
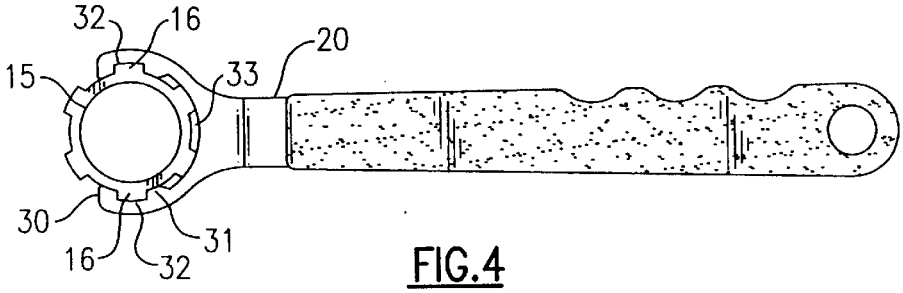
FIGS. 4 and 5 are top plan views of the wrench of this embodiment used with six-lug and eight-lug lock washers, respectively.
Figure 5:
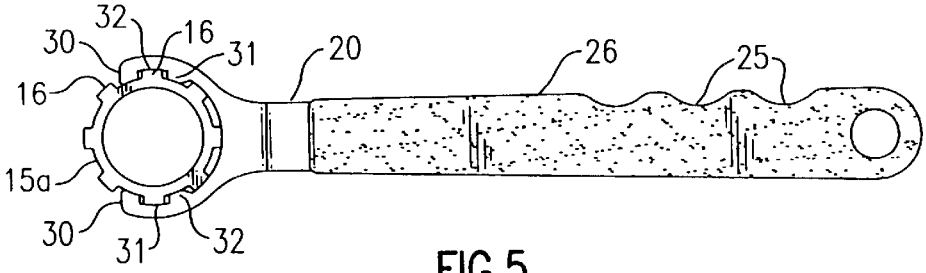

As shown in FIGS. 2, 4, and 5, the two spaces or gaps 32 are disposed diametrically opposite one another, and the arcuate surface 33 that extends between the two second teeth 31, 31 has an angular distance of at least 90 degrees of arc. The head 24 of the wrench can thus accommodate either a six-lug lock nut or an eight-lug lock nut, as shown in FIGS. 4 and 5.

The ends of the two jaws 28 and 29 define a gap 35 between one another of sufficient width to allow the head 24 to be placed over the conduit 12 so that the teeth and gaps thereon can engage the lock nut 15. Here the gap 35 and the arcuate surface 33 are centered on the axis of the handle 22. The jaws 28, 29 are also hog-nosed, that is, they end at a more-or-less transverse line after the outer edge of the first tooth 30. This shortens the jaw as much as possible, and permits a greater amount of angular throw when tightening the lock nut. Also, because a laser machining process can be used to form these from a steel sheet or plate, the jaws 28, 29 can be made rather narrow without sacrifice of strength, which also facilitates use of the wrench in tight locations. The comers of the teeth 30 and 31 that are adjacent the space 32 between them are sharp edged, that is, with a zero radius. This feature ensures that the wrench does not slip off the lugs, but rather captures them and contains the lock nut. The arcuate surface 33 meets the outer edges of the lugs that are facing it, and this feature combines with the capturing of the lugs within the spaces 32, so that the wrench acts as a spanner, and will contain and turn the lock nut 15, even where the lock nut is of very thin metal.

FIG. 4 illustrates the lock-nut wrench 20 being used on a six-lug or six-ear lock nut 15. Here there are six lugs 16 spaced at sixty-degree intervals, so there are two lugs diagonally opposite each other. The wrench head fits directly over the nut 15, with two of the lugs 16 fitting into the gaps or spaces 32 between the first and second teeth 30, 31, and with two of the lugs 16 fitting against the arcuate wall 33. FIG. 5 shows the same wrench used on an eight-lug lock nut 15*a*, i.e., a lock nut with eight lugs 16*a* spaced at forty-five degree intervals. Two of the lugs 16*a* are captured in the spaces or gaps 32 between the first and second teeth 30, 31, and three lugs 16*a* fit against the arcuate wall 33. Other lock nuts besides those shown here could also be accommodated.

The wrench 20 is as easy to use on a lock nut as the familiar open wrench is on a regular hex head bolt.

Figure 6:
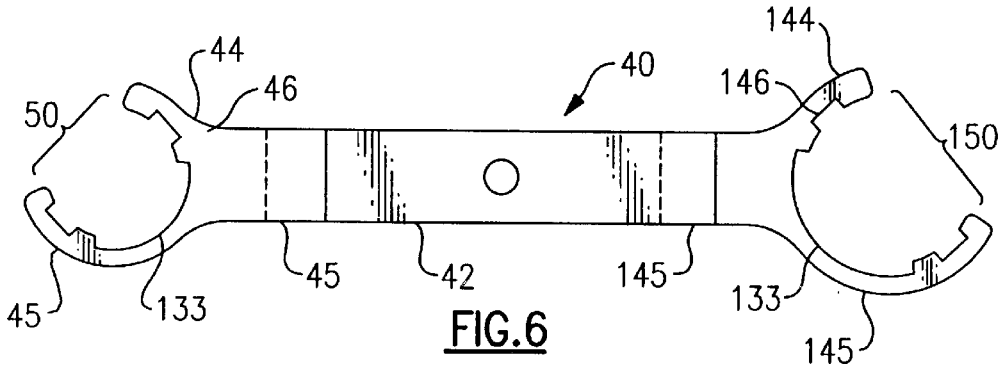
FIGS. 6 and 7 are plan and side views, respectively, of a lock nut wrench according to another embodiment of the invention.
Figure 7:
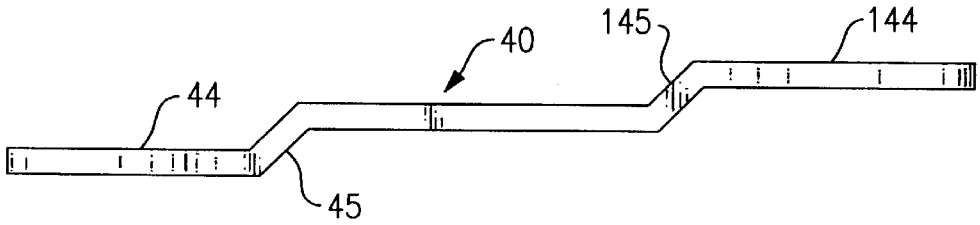

Another lock nut wrench 40 according to an alternative embodiment of this invention is shown in FIGS. 6 and 7. Here, the wrench is a double ended, open wrench to accommodate two different sizes of lock nuts. The wrench 40 has a central handle portion 42, with a first open head 44 at one end; and a second open head 144 at the other end, with first and second offsets 45, 145 joining the heads 44, 144 to the handle portion 42. As in the firs, embodiment each head has a pair of arcuate jaws 45, 46 and 145, 146, with a first tooth at the outer or proximal end, and a second tooth spaced in from the first tooth to define a gap to capture a lug of the lock nut. There is a gap or space 50, 150 between the two jaws for each head, and here these are oriented to one side, rather than in line with the axis of the handle as was the case in the embodiment of FIGS. 3 and 4. In this embodiment, there is an arcuate spanner surface 133. In other possible embodiments, additional teeth could be provided so that there are spaces for all of the lock-nut lugs except those that are situated in the gaps 50, 150, but the illustrated embodiments are preferred over that construction. The handle portion 42 can be given a plastic coating, if desired. Also, as in the first embodiment, the ends of the jaws are hog-nosed for optimal turning angle.

Figure 8:
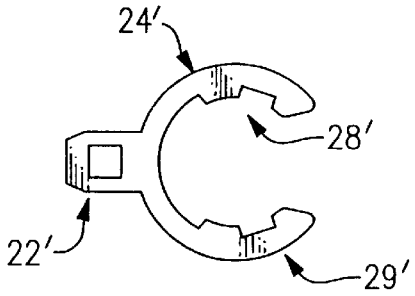
FIG. 8 is a top plan view of an embodiment which is adapted to receive a square-drive socket wrench handle.

Another possible embodiment, adapted for a square drive handle (the latter not shown) is illustrated in FIG. 8. Here, the lock nut wrench 20' has a head portion 24' , with a pair of jaws 29' and 30' as described previously, as well as a square-drive receiving tab 22' that projects from the head portion 24'. The tab 22' can be offset above the plane of the head 24'. The tab can be made to accept quarter-inch, three-eighths-inch, or other size square drive, or to accept a hex drive. A male member can be provided instead of a square or hex socket, so as to permit use of a female or tubular drive member, e.g., a hand-held power drill or driver.

It should be understood that the illustrated wrenches are each shown for particular sizes of lock nuts, but are representative of wrenches of a range of sizes. It is expected that the electrician would be provided with a set of wrenches each of a given size, so as to accommodate all common sizes of lock nuts, and so that these tools can be used on an extensive range of conduit sizes.

While the invention has been described hereinabove with reference to selected preferred embodiments, it should be recognized that the invention is not limited to those embodiments. Rather, many modification and variations would present themselves to persons skilled in the art without departing from the scope and spirit of this invention, as defined in the appended claims.

I claim:

1. A lock-nut wrench for tightening lock nuts that secure metal conduit to a metal electrical box, in which the lock nuts have a generally annular body with a female thread that engages a male thread on the conduit and a plurality of regularly spaced, radially-directed lugs, at least some of which have a portion that engages a metal wall of the electrical box when rotated tight on the conduit; said lock-nut wrench comprising handle means for permitting the wrench to be gripped by an electrician for turning, and a head situated at one end of said handle means, said head including right and left arcuate jaws having distal ends that define an opening sufficient to pass over the associated conduit, and each said jaw having a first radially inwardly directed tooth at its distal end and a second radially inwardly directed tooth spaced proximally therefrom; said first and second teeth of each jaw defining therebetween a space to accommodate one lug of said lock nut, with the space of each jaw being diametrically opposed with the corresponding space of the other jaw; with the remainder of said jaws proximal of said second teeth being free of further teeth and defining a cylindrical surface, of at least about 90 degrees of arc, that matches the outer extent of at least one lug of said lock nut.

2. The lock-nut wrench according to claim 1 wherein said head is unitarily formed.

3. The lock-nut wrench according to claim 2 wherein said handle means includes a handle member that is unitarily formed with said head.

4. The lock-nut wrench according to claim 3 wherein said handle means includes a member that is provided with an offset at a distal end thereof at which said member joins the head, so that the head and the proximal end of the handle member lie in substantially parallel planes.

5. The lock-nut wrench according to claim 3 wherein said handle member is covered with an insulating plastic coating.

6. The lock-nut wrench according to claim 1 wherein jaws and teeth are of a uniform thickness.

7. The lock-nut wrench according to claim 3 wherein said wrench further comprises a second head at a proximal end of said handle member.

8. The lock-nut wrench according to claim 1 wherein said handle means includes a tab having a portion formed therein to receive a removable drive handle.

9. The lock-nut wrench according to claim 8 wherein said tab has a square socket therein to receive a square drive handle.

10. The lock-nut wrench according to claim 1 wherein said jaws are hog-nosed and end at a transverse line at a distal edge of the first tooth of each jaw.

11. The lock-nut wrench according to claim 1 wherein the first and second teeth of each jaw are formed with zero radius corners.

12. A lock-nut wrench for tightening lock nuts that secure metal conduit to a metal electrical box, in which the lock nuts have a generally annular body with a female thread that engages a male thread on the conduit and a plurality of regularly spaced, radially-directed lugs, at least some of which have a portion that engages a metal wall for the electrical box when rotated tight on the conduit; said lock-nut wrench comprising an elongated handle that is adapted to be gripped by an electrician, and first and second heads at opposite ends of said handle, each said head including right and left arcuate jaws having distal ends that define an opening sufficient to pass over the associated conduit, and each said jaw having a first radially inwardly directed tooth at its distal end and a second radially inwardly directed tooth spaced proximally therefrom; said first and second teeth of each jaw defining therebetween a space to accommodate one lug of said lock nut, with the space of each jaw being diametrically opposed with the corresponding space of the other jaw; with the first and second heads being unitarily formed with said handle, and each said handle having first and second offsets at its respective ends.

13. The lock-nut wrench according to claim 12 wherein the openings between the jaws of said first and second heads are each directed to respective sides of an axis of the handle.

14. The lock-nut wrench according to claim 12 wherein said handle and said heads are of a uniform thickness.

* * * * *

UNITED STATES PATENT AND TRADEMARK OFFICE

CERTIFICATE OF CORRECTION

PATENT NO. : 6,745,648 B2
DATED : June 8, 2004
INVENTOR(S) : Randal J. Stier

It is certified that error appears in the above-identified patent and that said Letters Patent is hereby corrected as shown below:

Column 1,
Line 35, the semi-colon ";" between the words "have" and "been" should be deleted.

Column 4,
Line 18, "comers" should read -- corners --
Line 50, "firs" should read -- first --

Signed and Sealed this

Twentieth Day of July, 2004

JON W. DUDAS
*Acting Director of the United States Patent and Trademark Office*